US005452689A

United States Patent [19]

Karlan

[11] Patent Number: 5,452,689

[45] Date of Patent: Sep. 26, 1995

[54] ROTARY VALVE CAM ENGINE

[76] Inventor: Paul Karlan, c/o Karlan Toll Co. 511 Center Ave., Mamaroneck, N.Y. 10543

[21] Appl. No.: 236,050

[22] Filed: May 2, 1994

[51] Int. Cl.[6] ..... F02B 75/26

[52] U.S. Cl. ..... 123/56.2

[58] Field of Search ..... 123/56.2, 56.9, 123/55.3

[56] References Cited

U.S. PATENT DOCUMENTS

| | | | |
|---|---|---|---|
| 2,783,751 | 3/1957 | Karlan | 123/56.9 |
| 3,456,630 | 7/1969 | Karlan | 123/53.6 |
| 3,805,749 | 4/1974 | Karlan | 123/53.6 |
| 4,610,223 | 9/1986 | Karlan | 123/56.9 |
| 4,974,555 | 12/1990 | Hoogenboom | 123/55.3 |
| 5,218,933 | 6/1993 | Ehrlich | 123/56.2 |

*Primary Examiner*—David A. Okonshy

[57] ABSTRACT

A rotary valve cam engine of the type described in U.S. Pat. No. 3,456,630 and No. 4,610,223, where the bearing area to take the rotational forces of the cams and the thrust forces of the pistons are improved. Also an improved means of sealing the compression and power strokes of the pistons without inducing friction forces against the rotary valve. Also an improved cam structure which shortens the length of the engine.

6 Claims, 5 Drawing Sheets

FIG. 7
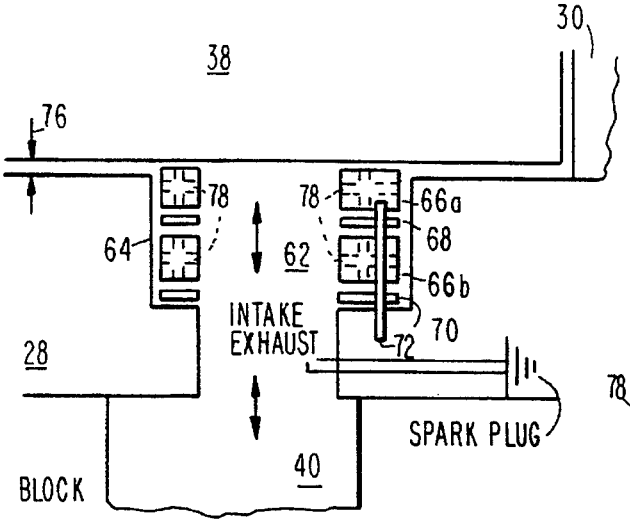
FIG. 8
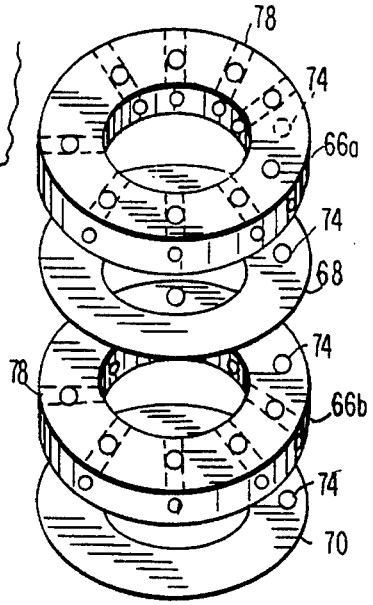
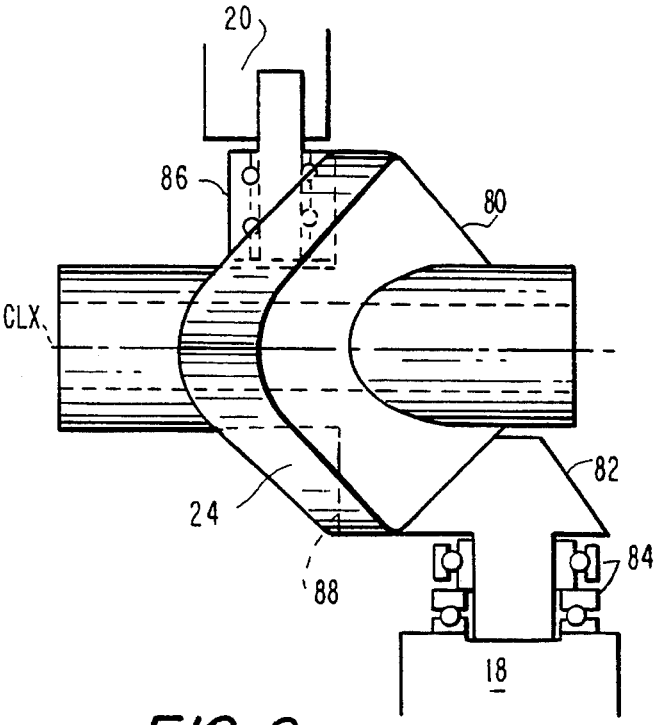
FIG. 9
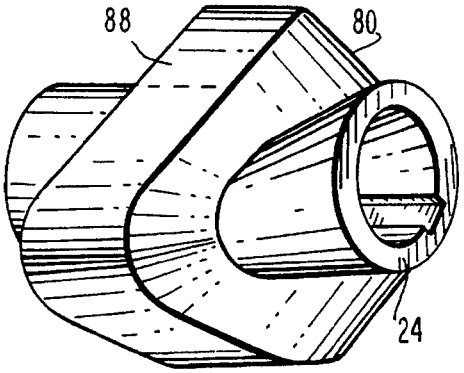
FIG. 10

ROTARY VALVE CAM ENGINE

BACKGROUND

1. Field of Invention

This invention provides for improvements in the operation of my Cam Engine, such as an improved reciprocating mechanism to increase the durability of the engine, also a seal for the rotary disc valve to make a better seal without adding any friction on the disc valve and also an improved cam to be shorter in length and therefore reducing the total length of the engine.

2. Description of Prior Art

In my previous design U. S. Pat. 3,805,749, Karlan, 1974, the guide rods, FIG. 1A, which take all the side thrust, were mounted on the connecting plate and they reciprocated while the bushings, FIG. 1B (bearings) mounted in the block were stationary. As shown in FIG. 1A the two guide rods were mounted on one side of the connecting plate. The pressure on the bushings, which were mounted in the block was not evenly distributed, with most of the pressure taken by the main bushings (bearings). FIG. 1B, nearest to the connecting plate. That arrangement caused excessive wear on the bushings nearest to the connecting plate and less wear on the secondary bushings on the side away from the connecting plate. Also, the long reciprocating guide rods made for a heavier reciprocating weight.

The object of this invention is to improve the more even distribution of the side pressure to all the bushings. Also, the new mounting of four guide rod bushings, FIG. 2, on the connecting plate allows for the use of more bearing area. The prior art only allowed for two guide rod, guide rod bushing arrangements on each connecting plate. Also, my new design of mounting the bushings onto the connecting plate allows for better compensation due to misalignment of the mating parts, because of tolerances, and differences in heat expansion between the block and the connecting plate.

A second improvement involves better sealing of the disc valve. In the prior designs as shown in U.S. Pat. Nos. 2,783,751 (1957), and 3,456,630 (1969) and 3,805,749 (1974) and 4,610,223 (1986) all by Karlan (myself) the sealing of the compression and power strokes was partial, and it was accomplished by making a small clearance between the disc valve and the cylinder head. However, if the clearance was to small the disc valve could bind or cease because of heat expansion or if the clearance was to big, some compression was lost on the compression and power strokes. The improvement here FIG. 7, allows for adequate clearance between the disc valve and the head to prevent heat expansion binding and also maintain good compression for the compression and power strokes.

A third improvement involves the design of the cam. In the old design as shown U.S. Pat. No. 4,610,223 the cam has sloped lobes on both sides, the power side and the return side. The lobes are sloped to give true rolling motion to the cam followers without inducing friction. However, in my improved design the return follower side of the cam is not sloped and it is made square to the shaft. The power side of the cam is still sloped because this side of the cam does most of the work. The follower side is only used in start-up of the engine and in some conditions of idling, therefore the follower side is not subject to the same work forces as the power side. In making the follower slope square or at right angle to the shaft and not sloped, the cam can be made shorter in length, therefore reducing the total length of the engine. Also, the follower cam bearing can be smaller reducing the weight of the reciprocating parts.

Further Objects and Advantages of my invention will become apparent from a consideration of the drawings and ensuing description. The inventive improvements will make this cam engine a practical engine able to compete with other designs in use.

BRIEF DESCRIPTION OF THE DRAWINGS

FIG. 7 shows a side (engineering) view of the seal rings and shims, located in the intake-exhaust port.

FIG. 8 shows a perspective view of the seal rings and seal shims.

FIG. 9 shows a side (engineering) view of the cam and location of the power and follower cam followers.

FIG. 10 shows a perspective view of the cam.

SUMMARY

The purpose of this invention is to provide an improved cam engine which will have a more durable reciprocating mechanism, which includes the pistons and the cam followers which transfer the power of the pistons to turn the main shaft. Also, to provide a more efficient method of sealing the rotating disc valve without adding any rubbing friction and to provide for an engine of shorter length by making the cams shorter without diminishing the purpose of the cams which is to transfer the reciprocating motion of the pistons to rotate the shaft. A shorter length engine is desireable when installed in a vehicle.

DETAILED DESCRIPTION OF THE DISCLOSED EMBODIMENTS

Figure 1B:
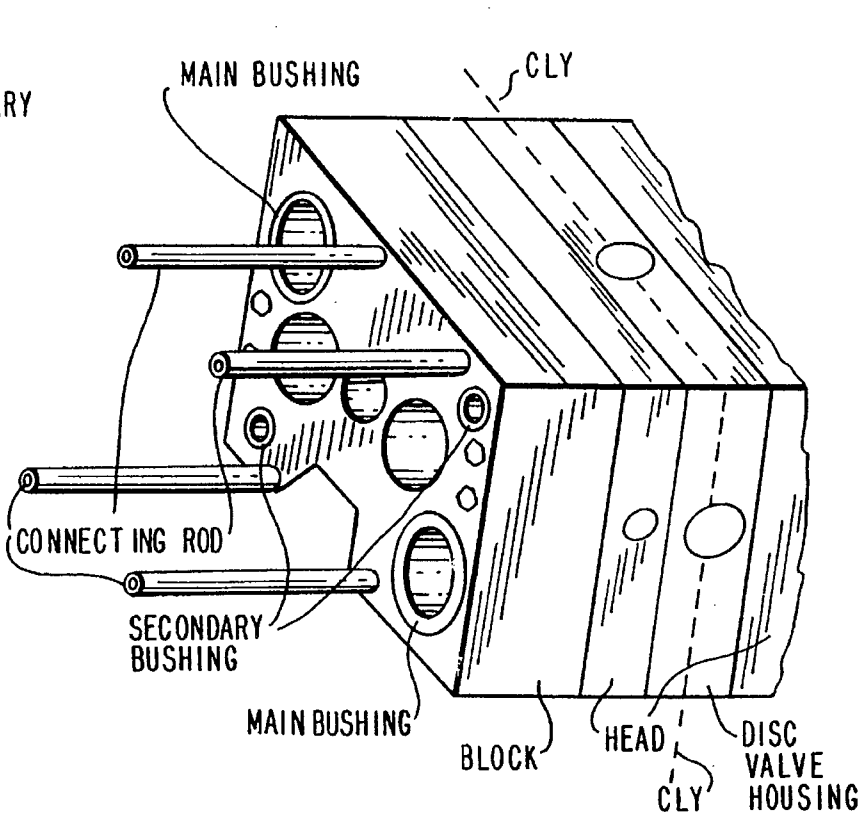
FIG. 1B PRIOR ART
FIG. 1A and 1B shows a perspective view of the prior art, where the two guide rods are mounted on the connecting plate and the bushings (bearings) are mounted in the block. The connecting rods connect the end plate to the block and are not bearing surfaces. Note, the connecting rods are eliminated in the new invention described below. The engine is symetrical on each side of the centerline, CLy.
Figure 1A:
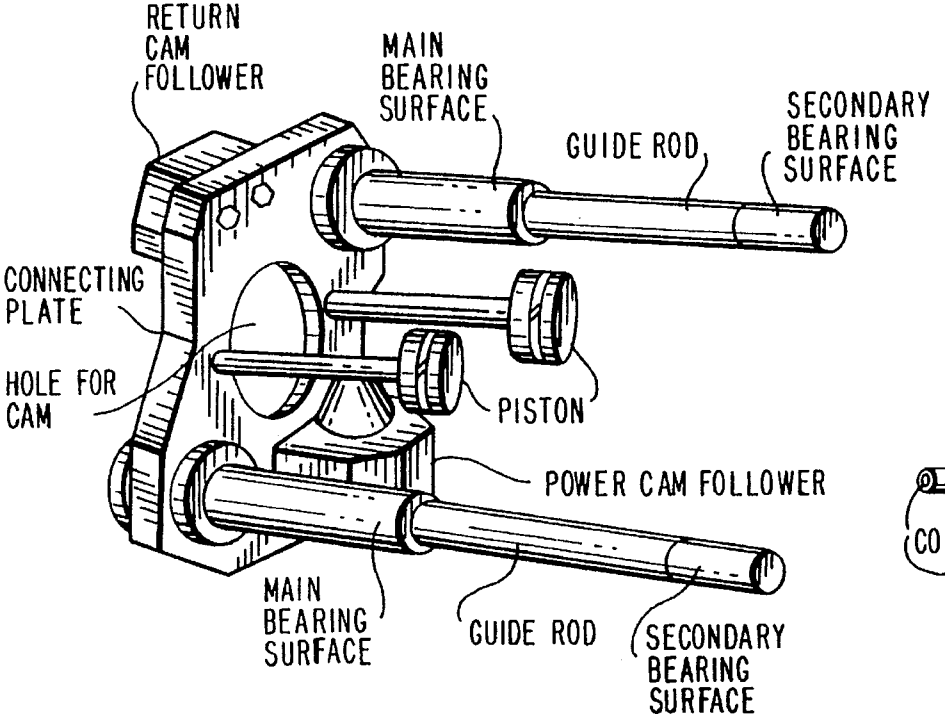
FIG. 1A PRIOR ART

FIGS. 1A and 1B shows on the prior art that two guide rods are attached to the connecting plate. The location of the pistons and the cam followers are fundamentally the same as in the improved mechanism. It is to be noted that my engine is symetrical longitudinally, the structure is the same on each side of the disc valve. There are two connecting plates, left and right, reciprocating in equal and opposite directions. The opposing forces cancel out each other to make a balanced engine. The left side connecting plate is shown here.

Figure 2:
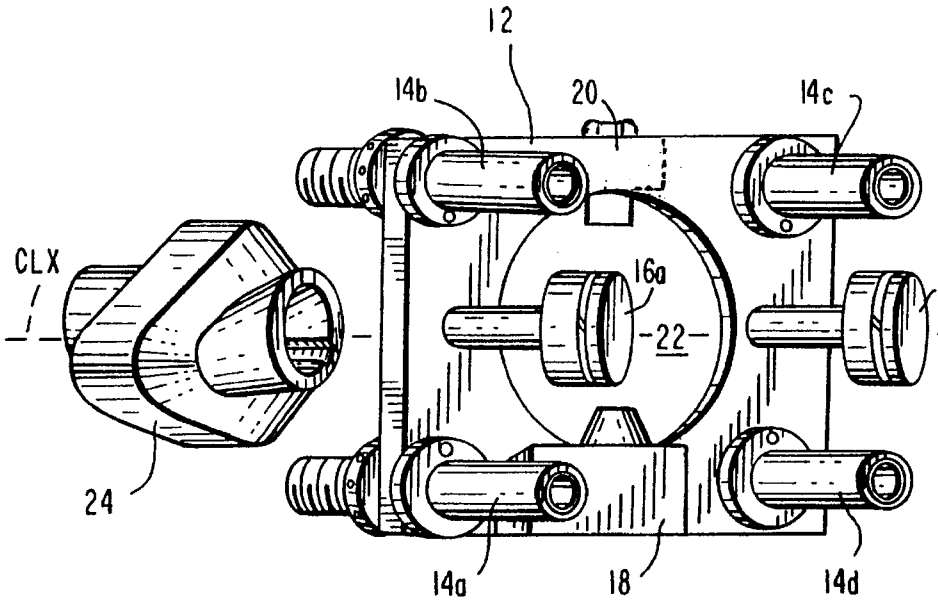
FIG. 2 shows a perspective view of the connecting plate, with the Guide Rod Bushings, pistons and cam followers.

FIG. 2 shows the new left side connecting plate 12, to which are mounted the guide rod bushings 14 *a, b, c, d.* Also mounted on the connecting plate 12, are pistons 16 *a* and *b*. Also mounted on the connecting plate is the power cam follower 18, and the return cam follower 20. The hole 22, in the connecting plate is the clearance hole for the cam.

Figure 3:
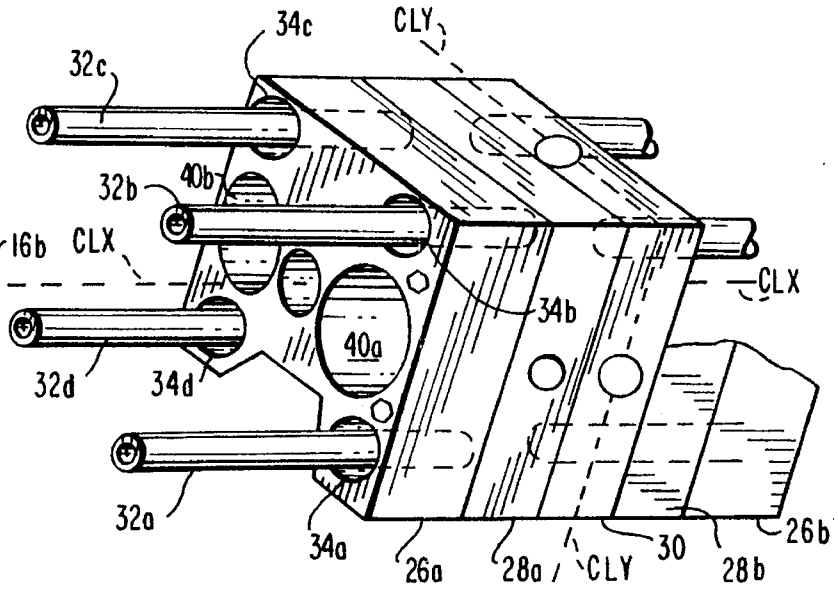
FIG. 3 shows a perspective view of the guide rods mounted on the block. Note, all parts are the same on both sides of the centerline CLy.

FIG. 3 shows a pespective view of the body of one half of the engine. It is to be noted that the body of the engine is the same on both sides of the centerline CLy. The body of the engine consists of blocks 26 *a* and *b*, cylinder heads 28 *a* and *b*, and the disc valve housing 30. Mounted to the body are the guide rods 32 *a, b, c, d*. The centerline of the main shaft CLx is also noted. The guide rods 32, extend thru the block 26 and arc, bolted to the head 28. Clearance holes 34 *a, b, c, d*, allow for the reciprocation of the bushings 14, to extend into the block and therefore allow for the construction of longer guide rod bushings.

Figure 4:
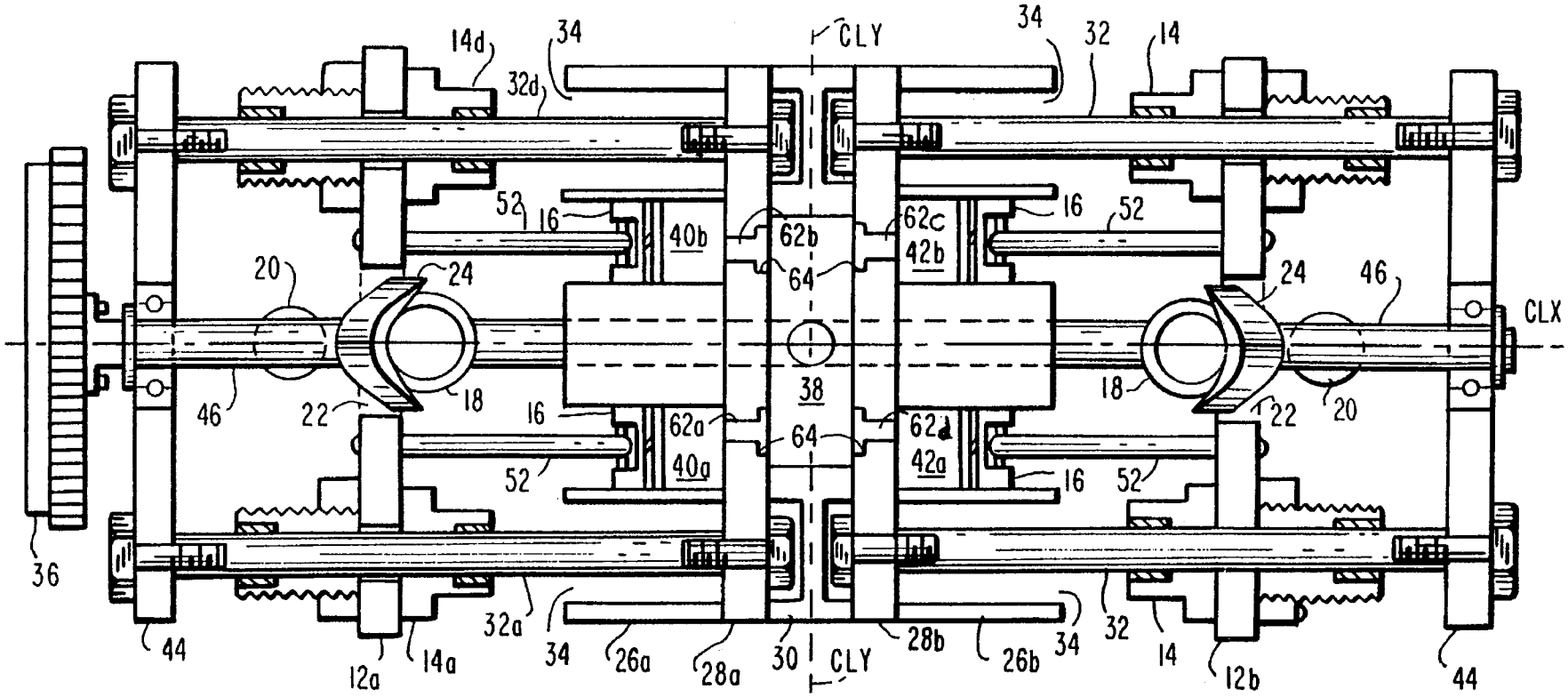
FIG. 4 shows a side (engineering) view of the complete length of the engine, including a side view of the connecting plate with the guide rod bushings.

FIG. 4 shows a mechanical side view of the whole engine, as indicated the parts are the same on each side of the centerline CLy, except that one side has the flywheel 36. The disc valve housing 30, holds the disc valve 38, which meters the intake and exhaust alternately to and from (the exhaust) the cylinders 40*a* and 42 *b*, and 40 *b* and 42 *b*. The connecting plates 12 *a* and *b*, reciprocate equal and opposite to each other creating a balanced motion. Note. FIG. 4, shows the engine rotated 90 degrees along its longitudinal axis CLx, as to FIG. 2 and 3. The guide rods 32, are also bolted to the end plates 44. Therefore the guide rods serve as bearing surfaces for the guide rod bushings 14 and also as supporters of the end plates 44. In the prior art connecting rods were required to support the end plates and had no bearing function. The end plates 44, hold the main bearings for the main shaft 46.

Figure 5:
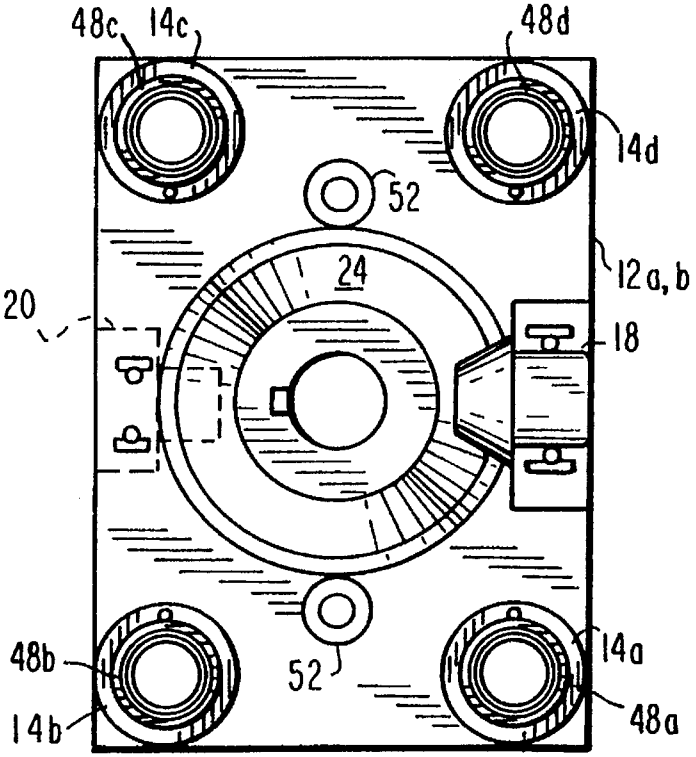
FIG. 5 shows an (engineering) end view of the connecting plate showing the location of the guide rod bushings, pistons and cam followers.

FIG. 5, shows a mechanical end view of the connecting plate 12. This description applies to both end plates 12 *a* and 12 *b*. On the connecting plate 12, are mounted the four guide rod bushings 14 *a, b, c,* and *d*. The guide rod bushings are mounted thru the holes 48 *a, b, c,* and *d*. The holes are slightly larger than the body diameter of the guide rod bushings 50, in FIG. 6. Also mounted on the connecting plate are the piston rods 52, and the return cam follower 20, and the power cam follower 18. The power cam follower is mounted on the same side of the connecting plate as the pistons and it takes the force of the compression and power strokes. The return cam follower 20, is used at start-up and in some conditions of idling, therefore the return cam follower can be made of a bearing with less capacity than the power cam follower. The piston rods 52, are attached to the pistons 16, FIG. 4, with a ball socket connection which takes any misalignment, there is no side pressure on the pistons, all side pressure is taken by the guide rod bushings 14.

Figure 6:
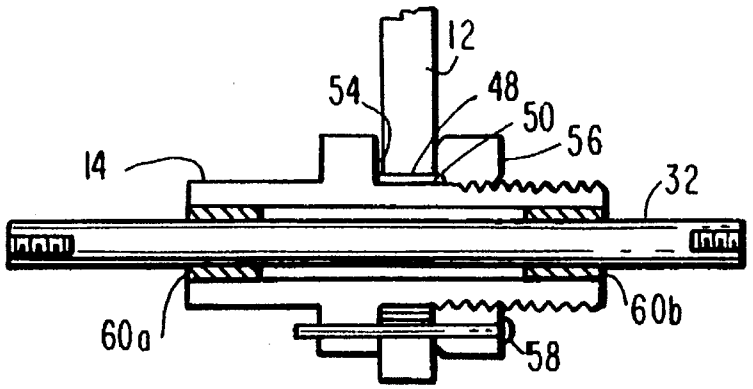
FIG. 6 shows an isolated (engineering) view of a guide rod bushing.

FIG. 6 is an isolated view of a guide rod bushing. As stated the guide rod bushing is located in hole 48 in the connecting plate 12. These holes are in alignment with the guide rods 32, that are mounted to the block. The guide rod bushing is constructed with a shoulder 54, the shoulder faces against the connecting plate and is held in contact by the threaded collar 56. The collar 56, is adjusted against the connecting plate with moderate pressure, this allows for slight misalignment due to machining differences and to differences in heat expansion between the connecting plate and the block. Thru the collar 56, the connecting plate 12, and the shoulder 54 of the bushing, is located a pin 58. This pin keeps the bushing from turning and loosening due to vibration. It is to be noted noted that other means of keeping the bushing in position can be used. Located in the hole in the bushing are bearings 60*a* and 60*b*. These bearings slide on the guide rod 32. The length of the bearings 60 are not specific and the construction may consist of two bearings as shown, in each guide rod bushing, in FIG. 6, or may be one long bearing. Also, the construction of this sliding bushing can be made so that the bearing surface is on the guide rod and the mating surface is on the internal diameter of the bushing.

FIG. 7, shows the improved method of sealing the disc valve 38, on the compression and power strokes of this four cycle engine. Located between the cylinder 40 and the disc valve 38, is the intake-exhaust port 62. The intake-exhaust port has a recess 64, In the recess 64, are located the valve rings 66*a* and 66*b*. Between the valve rings is located valve shim 68, A valve shim 70, is located between the valve ring 66*b*, and the bottom of the recess. A pin 72, is located in the cylinder head 28, and also in corresponding holes 74, in the valve rings and valve shims. There is slight clearance in these holes to allow the valve rings and valve shims to seat themselves without turning in the recess 64.

FIG. 8, shows a perspective view of the valve rings and shims. The valve rings and shims are slightly smaller in diameter than the diameter of the recess 64, so they will move with minimum leakage, There is slight clearance 76, FIG. 7, between the disc valve 38, and the head 28. This clearance is made so that the disc valve will rotate freely in the disc valve housing 30. When there is no pressure during the intake and exhaust strokes the total height of the valve rings and shims is level with the top surface of the head 28. When there is pressure in the intake-exhaust port 62, the pressurized gas (the air-fuel mixture) enters the cross holes 78, in the valve rings. The pressurized gas will than seperate the rings from the shims and the top ring from the disc valve. The total amount of seperation between the valve rings and the disc valve is equal to the clearance distance 76. The clearance between the top valve ring 66*a*, and the disc valve will be one quarter of the clearance 76. This reduced clearance between the top ring 66*a* and the disc valve greatly reduces the leakage and effectively seals the compression and power strokes of the engine cycles, without any rubbing or friction on the disc valve. It is to be noted that the more rings and shims that are used the better the seal will be, for example if three rings and shims are used, than the sealing distance between the top ring and the disc valve will be one sixth of the clearance 76. The gas pressure in the cross holes also keep the sides of the valve rings away from the wall of the recess 64 which has a slightly larger diameter. Thus allowing the valve rings and valve shims to move up and down in the recess 64 without binding. It is to be noted that the valve rings and shims do not have to be round, but precise clearance to the recess must be maintained, also the need for pin 72, would be eliminated if the shape of the hole is not round. Each cylinder has its own valve seal described above, the location of the seals are noted in FIG. 4, at 62*a, b, c, d*. The seal described above is not an absolute seal but since the leakage is a function of the distance between the top valve ring 66*a* and the disc valve 38, which is miniscule, and is also a function of the time of the operation of the compression and power strokes which is also miniscule, the leakage is insignificant and the seals work very well on my Working Model.

FIG. 9 shows a side, engineering view of the improved cam design.

FIG. 10, shows a perspective view of the cam. The lobe 80, is tapered so that the cam follower 82, has true rolling motion, without inducing friction on the calm lobe. The tapered side 80, takes the force of the compression and power strokes. The pressure against the tapered follower 82, is both radial and axial along the axis of the cam follower. Therefore the bearing arrangement in the power cam follower 18, must take both radial and thrust forces as indicated by 84, in FIG. 9. In the operation of this cam engine the force is always against the power cam follower when the engine is running. However, at start-up and in some conditions of idling positive reciprocating motion , provided by the return cam follower 20, is needed. Since the working forces on the return cam follower are less than the power cam follower, a smaller capacity cam follower 86, can be used. The lobe of the cam at 88, FIG. 9, for cam follower 86, is made square to the center line of the cam. This construction allows for a cam of shorter length, therefore the total length of the engine is shorter. The shorter length is desireable when installed in a vehicle, and many other applications. It is to be noted that this embodiment shows only one power cam follower and one return cam follower for each connecting plate. However, two power cam followers located 180 degrees apart and and two return cam followers located 180 degrees apart can also be used.

Thus the reader will see that this design provides a cam engine that has less reciprocating mass which means longer bearing life, there is more bearing area to take the side thrust of the rotational forces, there is better provision for misalignment of parts due to manufacturing tolerance differences and misalignment of parts due to differences in heat expansion of the mating parts. Also, this invention provides for better sealing of the gas-air mixture in the cylinders which makes for more power and efficiency and also this invention provides a more compact engine.

While my above description contains many specifications these should not be construed as limitations on the scope of the invention but rather as an exemplification of one preferred embodiment there of. Many other variations are possible, For example the use of additional cam followers as described above, also an engine with trapezoidial shaped valve rings to provide for more intake area in the same angular movement of the disc valve, also the cylinders and head could be made from one piece of metal or three pieces. Also, The cylinders and pistons can be made in other than round shapes. This description does not specify materials, standard materials are used to provide for the best properties in strength and weight needs. This invention as described above does not specify lubricating and cooling provisions, however standard pressurized and-or splash lubricating techniques can be used and standard liquid or air cooling techniques can be used. My Working Model uses splash lubrication and a circulating liquid coolant system. Also not shown in the embodiment but on my Working Model is the take-off for the alternator, magneto, water pumps attached to the end of the shaft opposite to the flywheel end. Also not shown in the embodiment is means of carburetion. My Working Model uses carburetors, fuel injection devices can also be used. Also not shown, standard starter means. Accordingly, the scope of this invention should be determined not by the embodiments illustrated, but by the appended claims and other legal equivalents.

| Reference Numerals in Drawings | |
|---|---|
| 12 | Connecting plate. |
| 14 | Guide rods. |
| 16 | Pistons. |
| 18 | Power cam follower,. |
| 20 | Return cam follower. |
| 22 | Hole in connecting plate for location of cam. |
| 24 | Cam |
| 26 | Engine block, contains cylinders. |

-continued

| Reference Numerals in Drawings | |
|---|---|
| 28 | Cylinder heads. |
| 30 | Disc valve housing |
| 32 | Guide rods. |
| 34 | Clearance holes in block for guide rod bushings. |
| 36 | Flywheel |
| 38 | Disc valve. |
| 40 | Cylinders, in left block. |
| 42 | cylinders in right block FIG. 4. |
| 44 | End plate. |
| 46 | Main shaft. |
| 48 | Mounting holes in connecting plate for guide rod bushings. |
| 50 | Outside diameter of guide rod bushings, FIG. 6. |
| 52 | Piston rods. |
| 54 | Shoulder of guide rod bushings. |
| 56 | Threaded collar on guide rod bushing. |
| 58 | Anti-loosening pin thru guide rod bushing. |
| 60 | Bearings (such as bronze bearings) |
| 62 | Intake-Exhaust port in the cylinder head, FIG. 7. |
| 64 | Recess in head to hold valve rings. |
| 66 | Valve rings. |
| 68 | Middle valve shim. |
| 70 | Bottom valve shim. |
| 72 | Pin thru valve rings and shims to prevent the parts from turning. |
| 74 | The hole in the rings and shims for the above part. |
| 76 | Clearance distance between disc valve and cylinder head, FIG. 7. |
| 78 | Cross holes in valve rings. |
| 80 | Tapered lobe of cam, FIG. 9. |
| 82 | Tapered cam follower, spindle. |
| 84 | Radial and thrust bearings mounted in power cam follower. |
| 86 | Follower cam bearing. |
| 88 | Lobe face for the follower cam bearing. |

I claim:

1. A rotary valve cam engine comprising:

two connecting plates, each reciprocating along a longitudinal axis of the engine and respectively located on opposite ends thereof, a central output shaft extending along said longitudinal axis, each connecting plate having secured thereto a plurality of guide rod bushings, piston assemblies and cam followers, an engine body having cylinders, said engine body having a plurality of guide rods mounted at one end thereon, said cylinders and guide rods extending parallel to said central output shaft, said rotary valve being a disc valve coaxial with and driven by the output shaft, said disc valve closing an upper portion of said cylinders, means for sealing each respective cylinder upper portion with said disc valve responsive to cylinder pressure increase to prevent cylinder pressure leakage therebetween, and, two cylindrical cams, each respectively coaxially mounted on said output shaft and being engaged by said respective cam followers on said respective connecting plates, each said cylindrical cam having two different lobe faces, said lobe faces each imparting equal piston strokes.

2. The rotary valve cam engine of claim 1, wherein the guide rod bushing are of such length that each has an end which longitudinally extends beyond the cam followers.

3. The rotary valve cam engine of claim 1, wherein each said guide rod bushing is mounted to the connecting plate with a self aligning connection.

4. The rotary valve cam engine of claim 1, wherein the guide rods have suitable bearing surfaces that interface with the guide rod bushings.

5. The rotary valve cam engine of claim 1, wherein the guide rods have sufficient length and strength to mount such to end plates at ends opposite said one end.

6. The rotary valve cam engine of claim 1, wherein the sealing means consists of multiple elements positioned to reduce valve clearance.

* * * * *